US005664269A

United States Patent [19]

Broder

[11] Patent Number: 5,664,269

[45] Date of Patent: Sep. 9, 1997

[54] FOLDABLE BLANKET FOR REVEALING DIFFERENT PATTERNS

[76] Inventor: Donna Broder, 369 S. Doheny Dr. Ste. 169, Beverly Hills, Calif. 90211

[21] Appl. No.: 745,021

[22] Filed: Nov. 7, 1996

[51] Int. Cl.[6] ..... A47G 9/00

[52] U.S. Cl. ..... 5/486; 5/482; 5/502; 5/496

[58] Field of Search ..... 5/482, 486, 495, 5/496, 499, 500, 502

[56] References Cited

U.S. PATENT DOCUMENTS

| | | | |
|---|---|---|---|
| 2,730,728 | 1/1956 | Roberts | 5/486 |
| 3,273,176 | 9/1966 | Miller | 5/486 |
| 3,331,088 | 7/1967 | Marquette | 5/334 |
| 3,355,748 | 12/1967 | Tuvert | 5/502 |
| 3,508,284 | 4/1970 | Marquette | 5/334 |
| 3,508,285 | 4/1970 | Marquette | 5/334 |
| 3,530,516 | 9/1970 | Marquette | 5/334 |
| 4,005,499 | 2/1977 | Klein | 5/334 |
| 4,069,526 | 1/1978 | Deikel | 5/343 |
| 4,546,508 | 10/1985 | Ison | 5/494 |
| 4,875,245 | 10/1989 | Isola | 5/482 |
| 4,878,258 | 11/1989 | Casey | 5/420 |
| 5,007,125 | 4/1991 | Owenby | 5/486 |
| 5,023,969 | 6/1991 | Nattrass | 5/486 |
| 5,251,350 | 10/1993 | Bordenave, Sr. et al. | 5/482 |
| 5,457,830 | 10/1995 | Fox et al. | 5/486 |

*Primary Examiner*—Steven N. Meyers
*Assistant Examiner*—Tuyet-Phuong Pham
*Attorney, Agent, or Firm*—Gene Scott-Patent Law & Venture Group

[57] ABSTRACT

A bedding cover is described for use on a bed. The cover has a flap positioned at its center, and extends laterally from one side to the other. The flap may be folded to cover one or the other ends of the cover, and is large enough to fully cover the selected end. The flap has the bedding pattern of one end of the cover on one side and of the other end of the cover on the other side so that when it is folded to cover the first side, the entire surface of the cover presents a uniform appearance, and when it is folded to cover the other side, the entire surface of the cover presents a uniform appearance also, but of a selected different design or color, etc. In a second embodiment, the reverse side of the cover may be constructed to provide a third and a fourth appearance when the cover is turned over.

2 Claims, 2 Drawing Sheets

FOLDABLE BLANKET FOR REVEALING DIFFERENT PATTERNS

BACKGROUND OF THE INVENTION

1. Field of the Invention

This invention relates generally to blankets and bedclothes, and more particularly to a blanket having one or two hingable flaps capable of being folded so as to reveal up to four different patterns.

2. Description of Related Art

The following art defines the present state of this field:

Fox et at., U.S. Pat. No. 5,457,830 describes a bed divider with a delineation of the centerline of a bed by incorporating visible and tactile decoration into the centerline of form fitted bottom sheeting.

Bordenave, Sr. et at., U.S. Pat. No. 5,251,350 describes an improved interchangeable bedspread comprising a plurality of panels which are each reversible and interchangeable to provide a wide variety of different visual effects.

Nattrass, U.S. Pat. No. 5,023,969 describes an arrangement for a cover sheet and/or blanket to allow full or partial use by persons sleeping or resting in a side-by-side position. The cover unit is constructed whereby the sheet/blanket is split and each person may have the warmth provided by a complete unit or, alternatively, the coolness provided by no covering without disturbing the needs of the adjacent person.

Owenby, U.S. Pat. No. 5,007,125 describes a blanket having improved thermal characteristics in the portion covering the feet. There is provided a blanket constructed of a woven rectangular panel with an upper portion for covering the user's torso and with a lower portion for covering the user's feet. The filler yarn is thicker in the lower portion than in the upper portion and the weave is also more dense in the lower portion. Thus the feet of the user will be better insulated than the user's torso.

Casey, U.S. Pat. No. 4,878,258 describes an energy saving covering module that includes a central body portion having a pair of spaced apart walls defining and interior space containing insulating material. A first flange extends from the peripheral edges of the central body portion. A second flange can extend from either the central body portion or the outer peripheral edge of the first flange for overlying the first flange on an adjacent covering module to form an infiltration barrier against the transmission of heat energy and water vapor. The second flange can be either symmetrical or asymmetrical with respect to the first flange. A symmetrical or an asymmetrical third flange can extend from the central body portion on the opposite side of the first flange from the second flange and cooperate with the first flange of an adjacent covering module to form an infiltration barrier. The module is formed of flexible material which can be waterproof and any suitable fastener can be utilized to attach the modules together.

Isola, U.S. Pat. No. 4,875,245 describes bed clothes having first and second ends, sides, sections or areas, with means on the first section or area depicting a first article or the like, and means on the second section or area depicting a second article or the like, whereby when the bed clothes are placed upon a bed or similar area of repose, with said one section or area arranged adjacent the head position of the bed and associated bed clothes covering the second section or area thereof, the visual impression is given the bed clothes has solely the first article, and when said bed clothes are reversed, the visual impression is given that the bed clothes has solely the second article.

Ison, U.S. Pat. No. 4,546,508 describes a bedding assembly. This bedding assembly comprising of a base encompassing portion, a base covering portion and a body covering portion. This invention provides a simple and convenient means for making a bed.

Deikel, U.S. Pat. No. 4,069,526 describes a bed covering apparatus that includes a blanket member of a size approximately at least equal to the size of the bed and including first and second coverlet members of a size substantially equal to one-half of the size of the blanket member. The coverlet members are removably and pivotably attached tot he center section of the blanket member. The first coverlet member can be pivoted from a first position adjacent to and resting on the right half of the blanket member to a second position adjacent to and resting on the second coverlet member. The second coverlet member can be pivoted from a third position adjacent to and resting on the left half of the blanket member to a fourth position adjacent to and resting on the first coverlet member.

Klein, U.S. Pat. No. 4,005,499 describes a bed covering such as a blanket or sheet with two separately cleanable and washable halves or parts, to be utilized independently and with tie means for removably connecting the parts together to form a complete assembly. Each part has its own individual characteristics suited tot he needs of two persons, for example, sleeping in a double bed. The connecting means is of a type that facilitates cleaning or washing without damage to the covering and each part is provided with pocket means for removably carrying an individualized treated pad or packet.

Marquette, U.S. Pat. No. 3,530,516 describes a blanket for a bed constructed of two separate halves having different thicknesses or warmth characteristics with each half having one-half of a slide-type fastener along each edge thereof to enable the blanket halves to be interchanged with each other or with additional blanket halves of different thicknesses.

Marquette, U.S. Pat. No. 3,508,285 describes a blanket for a bed provided with a multiple panels of different warmth characteristics oriented in edge to edge relation at the center of the bed to enable the panels forming the blanket to have different warmth characteristics to satisfy the warmth requirements of the occupants of the bed which are covered by the panels. One half of the blanket may be constructed of a plurality of panels of different warmth characteristics with the multiple panels being secured together by a stitching assembly or secured together by a detachable fastening assembly to enable the panels to be separated from each other and assembled in a selected arrangement so that the half panels may have the desired warmth characteristics to satisfy the requirements of the individual occupants of the bed.

Marquette, U.S. Pat. No. 3,508,284 describes a blanket for a bed constructed of halves having different warmth characteristics in which the halves are unitary with each other thus forming a one-piece blanket capable of being formed with a single weaving operation by varying the characteristics of the weave in on e half of the blanket as compared with the other half thus forming different warmth characteristics.

Marquette, U.S. Pat. No. 3,331,088 describes a bed covering that is distinct and different in the art that it comprises, in combination, a regular blanket (for single or double bed), one or two attachable and detachable thickness increasing or decreasing top panels for selective occupant adjustment and use, quick separable marginal holddown fasteners therefor, with or without buttons and buttonholes, optional half-panels at the foot end of the blanket and panel means respectively, and independent buttoning and slide fastening means for these half-panels.

The prior art teaches the use of separable and joinable bedding portions, as in Deikel. Additionally, the prior art teaches the use of a flap for covering one or another portions of a bedding, such as in Nattrass. However, the prior art does not teach that a bedding may use a flap to fully cover one portion or another of a bedding so as to result in a complete change in appearance of the bedding. Further, the prior art does not teach such a bedding that is reversible so as to achieve four separate design appearances. Additionally, such a bedding has not been taught whereby two flaps may be used to achieve greater versatility in warmth selection. The present invention fulfills these needs and provides further related advantages as described in the following summary.

SUMMARY OF THE INVENTION

The present invention teaches certain benefits in construction and use which give rise to the objectives described below.

The present invention provides a bedding for use preferably as a cover on a bed. The invention teaches a construction capable of easily folding one portion over a second portion so as to change the entire appearance of the bedding as well as to change the areas of the bedding that provide greatest warmth.

A primary objective of the present invention is to provide a bedding that is able to easily be changed in appearance in such a manner that is not taught by the prior art. Another objective is to provide such a bedding cover that is able to provide the convenience of adjusting the thickness of the bedding in accordance with where the greatest warmth is desired.

A further objective in the present invention is to provide a bedding cover with a flap that is able to be positioned in one of two positions on the bedding, and which is sewn so that no flap seam is evident on the out-facing surface.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
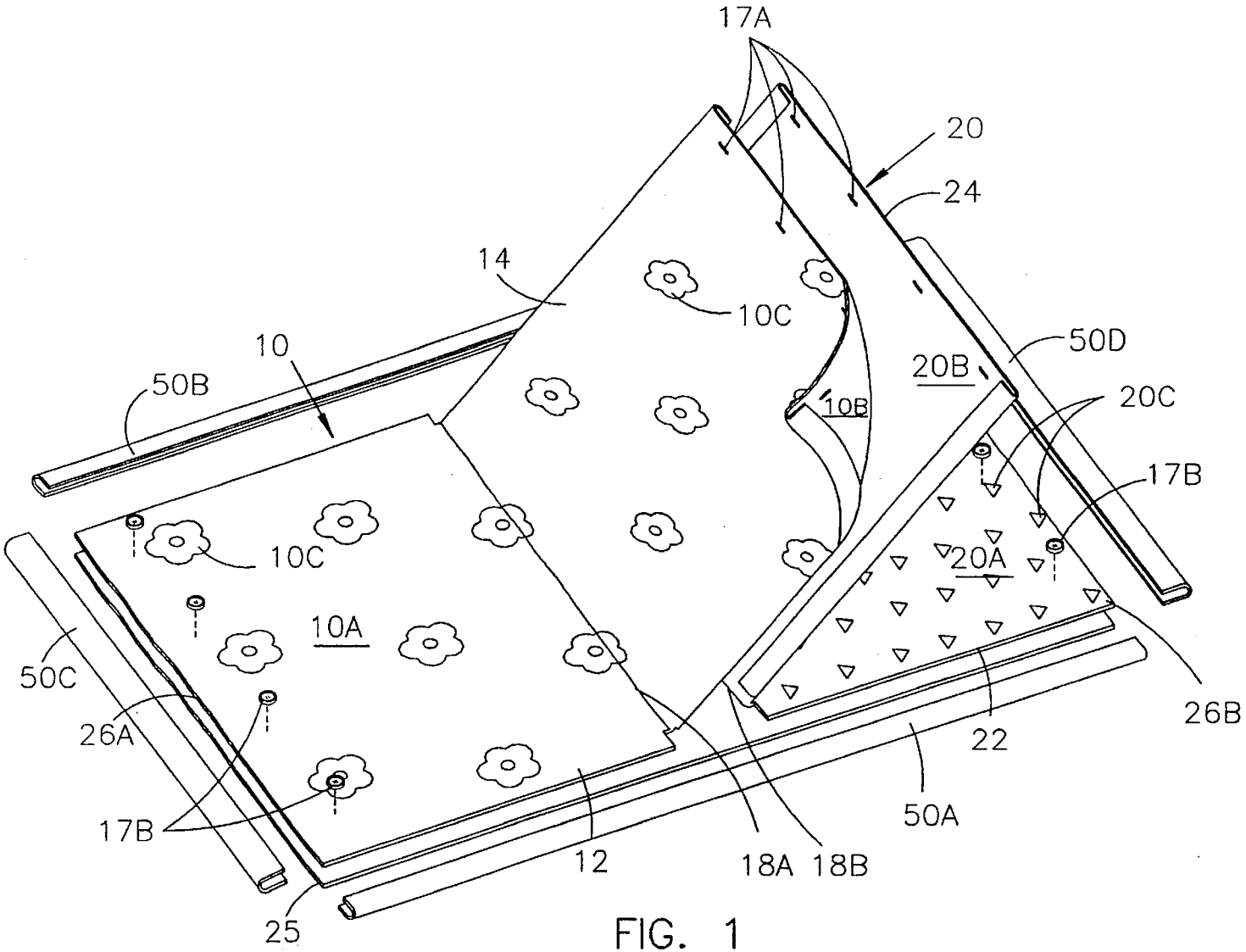
FIG. 1 is a perspective exploded view of a first preferred embodiment of the present invention.

The above described drawing figures illustrate the invention, a bedding cover, blanket or comforter. In a first embodiment as shown in FIG. 1 as an exploded view, the bedding includes a first sheet 10, preferably made of a fabric material of cotton or other common bedding material, and having a first sheet top side surface 10A and a first sheet bottom side surface 10B. The first sheet top side surface 10A presents a first decorative indicia 10C thereon, in this example shown as a flower pattern. For purposes of illustration and description as to construction and workability, the first sheet 10 including a first rectangular base portion 12 and contiguous thereto, a first rectangular hinged portion 14. A second sheet 20 has a second sheet top side surface 20A and a second sheet bottom side surface 20B. The second sheet top side surface 20A presents a second decorative indicia 20C thereon, in this case, a triangle pattern. The second sheet 20 includes a second rectangular base portion 22 and contiguous thereto, a second rectangular hinged portion 24. The word "hinged" is used in its general sense, as no hinge, per se, is included, but the hinged portions 14 and 24 are considered to be movable as flaps with respect to their base portions for purposes to be defined below.

The first and second hinged portions 14 and 24 correspond in size and shape, so that when the bottom side surfaces 10B and 20B of these hinged portions 14, 24 are sewn together they are made to form an integral hinge element 14/24 (see FIG. 2), having a common distal free edge 16. The first and second sheets 10, 20 are joined along linear intersections 18A and 18B respectively which form, conceptually, junctions between the bases 12 and 22 and the hinged 14 and 24 portions respectively of the sheets 10 and 20. In the preferred construction, the free peripheral edges of the hinged portions are turned under and sewn together. The base portions present free edges 26A and 26B which define the lateral extend of the present bedding. The hinge element 14/24 provides, along the hinge element distal free edge 16, a means for attaching 17A, button holes in the present embodiment, of the hinge element 14/24 to a means for receiving 17B, buttons in the present embodiment, which are positioned along the fee ends of the bedding, adjacent to hems 50C and 50D, of both of the base portions 12 and 22. When the hinge element 14/24 is buttoned down to the base portion, on either side, the several portions establish a single bedding blanket, cover or comforter with a single indicia or pattern presented. As shown in FIG. 1, hems 50A and 50B are positioned on the long edges of the bedding, while hems 50C and 50D are positioned along the shorter edges of the bedding. These hems enable the edges oft he bedding to be smooth and they cover the joining of the various separate sheets or portions of material. Preferably, a bottom sheet 25 is sewn to the base portions 12, 22 to establish the reverse side of the bedding. In use, this embodiment enables the bedding to be used to cover a bed with any one of three separate patterns or colors, etc. When the bottom sheet 25 is positioned facing upwardly on a bed, a first decorative effect is achieved by virtue of the pattern or color of the bottom sheet 25. When the top surfaces 10A and 20A are positioned facing upwardly on a bed, and the hinge element 14/24 is folded to one side of the bedding, i.e., toward hem 50C, a second decorative effect is achieved. When the hinge element 14/24 is folded to the other side of the bedding, i.e., toward hem 50D, a third decorative effect is achieved. The construction is such that no seam is visible on the out-facing surface of the bedding when it is laid over a bed. Also, the method of assembly of the present invention result in a stronger bedding structure as compared to bedding described in the prior art.

Figure 2:
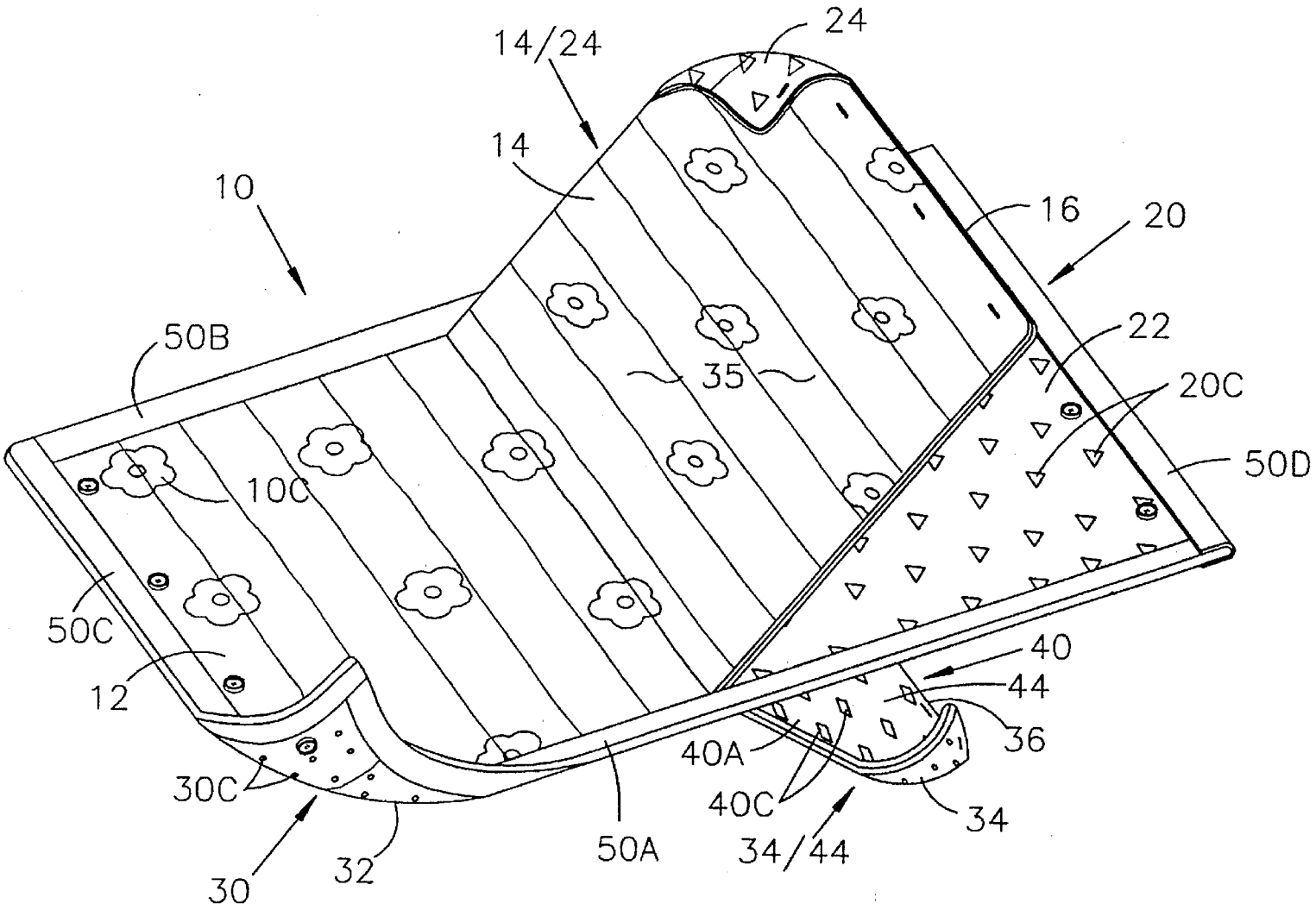
FIG. 2 is a perspective view of a second preferred embodiment of the present invention.

In a second embodiment as shown in FIG. 2 as a perspective view, a third sheet 30 has a third sheet top side surface and a third sheet bottom side surface, not visible in the figure as it is sewn into contact with the bottom side surface 10B of sheet 10. The third sheet top side surface presents a third decorative indicia 30C thereon. The third sheet 30 includes a third rectangular base portion 32 and contiguous thereto, a third rectangular hinged portion 34. Likewise: a fourth sheet 40 has a fourth sheet top side surface 40A and a fourth sheet bottom side surface, again, not visible. The fourth sheet top side surface 40A presents a fourth decorative indicia 40C thereon. The fourth sheet 40 includes a fourth rectangular base portion and contiguous thereto, a fourth rectangular hinged portion 44.

The third and fourth hinged portions 34 and 44 correspond in size and shape, the bottom side surfaces thereof being sewn together as an integral lower hinge element 34/44 having a common distal free edge 36. The third and fourth sheets 30 and 40 are joined along linear intersections which correspond to the intersections 18A and 18B shown in FIG. 1 for sheets 10 and 20. These form the junctions, conceptually, between the base and the hinged portions of the sheets 30 and 40.

The lower hinge element 34/44 provides, along the lower hinge element distal free edge 36, the means for attaching 17A the lower hinge element distal free edge 36 to the means for receiving 17B at either one of the lower base portions 32 or 34. Therefore, the means for receiving 17B is included on both the upper base portions 12 and 22 as well as the lower base portions. In the present embodiment, this means that buttons are sewn on both the top as well as the bottom of the bedding. The attachment means may also be snaps, Velcro® fasteners or other well known forms of fasteners appropriate to the instant invention.

It is obvious in FIG. 2 that the lower base portions are sewn to the upper base portions to form a single bedding assembly, and the hems 50A, B, C, and D are used to edge the assembly. It is clear also, as shown in both FIG. 1 and FIG. 2 that the bedding may be constructed with laterally extending and spaced apart sewn lines 35 for holding the bedding assembly together.

In use, the upper and the lower hinge elements 14/24 and 34/44 are folded over into contact with the respective base portions as previously described, and attached by using the attaching means 17A with receiving means 17B, in each case. In this manner, one of four decorative patterns or colors may be selected from the single bedding of this invention depending upon which side of the bedding is upfacing and which direction the upfacing hinge element is folded over onto the base portion of the bedding.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. Bedding comprising:

a first sheet having a first sheet top side surface and a first sheet bottom side surface, the first sheet top side surface presenting a first decorative indicia thereon, the first sheet including a first rectangular base portion and contiguous thereto, a first rectangular hinged portion, the base and hinged portions being of approximately equal size;

a second sheet having a second sheet top side surface and a second sheet bottom side surface, the second sheet top side surface presenting a second decorative indicia thereon, the second sheet including a second rectangular base portion and contiguous thereto, a second rectangular hinged portion, the second base and hinged portions being of approximately equal size;

the first and second hinged portions corresponding in size and shape, the bottom side, surfaces thereof being sewn together as an integral hinge element having a common distal free edge, the first and second sheets being joined along linear intersections between the base and the hinged portions of the sheets to establish a pair of opposing distal base portions free edges thereof;

the hinge element providing, along the hinge element distal free edge, a means for attaching the hinge portion distal free edge to a means for receiving at either one of the base portions free edges, the hinge element fully covering the base portion upon which it is folded onto.

2. Bedding comprising:

a first sheet having a first sheet top side surface and a first sheet bottom side surface, the first sheet top side surface presenting a first decorative indicia thereon, the first sheet including a first rectangular base portion and contiguous thereto, a first rectangular hinged portion;

a second sheet having a second sheet top side surface and a second sheet bottom side surface, the second sheet top side surface presenting a second decorative indicia thereon, the second sheet including a second rectangular base portion and contiguous thereto, a second rectangular hinged portion;

the first and second hinged portions corresponding in size and shape, the bottom side surfaces thereof being sewn together as an integral upper hinge element having a common distal free edge, the first and second sheets being joined along linear intersections between the base and the hinged portions of the sheets to establish a pair of upper opposing distal base portions free edges thereof;

the hinge element providing, along the hinge element distal free edge, a means for attaching the hinge portion distal free edge to a means for receiving at either one of the base portions free edges;

a third sheet having a third sheet top side surface and a third sheet bottom side surface, the third sheet top side surface presenting a third decorative indicia thereon, the third sheet including a third rectangular base portion and contiguous thereto, a third rectangular hinged portion;

a fourth sheet having a fourth sheet top side surface and a fourth sheet bottom side surface, the fourth sheet top side surface presenting a fourth decorative indicia thereon, the fourth sheet including a fourth rectangular base portion and contiguous thereto, a fourth rectangular hinged portion;

the third and fourth hinged portions corresponding in size and shape, the bottom side surfaces thereof being sewn together as an integral lower hinge element having a common distal free edge, the third and fourth sheets being joined along linear intersections between the base and the hinged portions of the sheets to establish a pair of lower opposing distal base portions free edges thereof;

the lower hinge element providing, along the lower hinge element distal free edge, a means for attaching the lower hinge portion distal free edge to a means for receiving at either one of the lower base portions free edges;

the first and third, and the second and fourth bottom side surfaces being joined respectively to form an integral common sheet.

* * * * *